United States Patent [19]

DeBack

[11] Patent Number: 4,984,801

[45] Date of Patent: Jan. 15, 1991

[54] GOLF SWING MUSCLE STRENGTHENER AND SWING DEVELOPER DEVICE

[76] Inventor: James A. DeBack, 3443 Baywood Cir., Antoich, Calif. 94509

[21] Appl. No.: 463,552

[22] Filed: Jan. 11, 1990

[51] Int. Cl.[5] ..... A63B 69/36

[52] U.S. Cl. ..... 273/186 A; 273/186 C; 273/193 A; 273/194 B

[58] Field of Search ..... 273/186 A, 186 C, 186 R, 273/81 A, 80 R, 194 B, 194 R, 193 B, 193 A, 193 R, 191 R

[56] References Cited

U.S. PATENT DOCUMENTS

| | | | |
|---|---|---|---|
| 1,930,342 | 10/1933 | Graham | 273/35 |
| 2,482,015 | 9/1949 | McConnell | 273/194 R |
| 3,351,346 | 11/1967 | Strahan | 273/193 |
| 3,722,890 | 3/1973 | Wieboldt | 273/186 A |
| 3,740,053 | 6/1973 | Eiger | 273/194 B |
| 3,758,117 | 9/1973 | Harrison | 273/194 B |
| 3,820,795 | 6/1974 | Taylor | 273/186 A |
| 4,170,356 | 10/1987 | Banks | 273/186 A |
| 4,381,111 | 4/1983 | Richards | 273/191 R |
| 4,444,396 | 4/1984 | Wendt | 273/193 A |
| 4,602,788 | 7/1986 | Wendt | 273/193 A |
| 4,664,388 | 5/1987 | Huber | 273/186 A |
| 4,682,775 | 7/1987 | Wood | 273/186 C |
| 4,842,280 | 6/1989 | Hilton | 273/194 B |

FOREIGN PATENT DOCUMENTS

| | | | |
|---|---|---|---|
| 437905 | 11/1935 | United Kingdom | 273/186 A |
| 472237 | 9/1937 | United Kingdom | 273/194 R |

*Primary Examiner*—Benjamin Layno

*Attorney, Agent, or Firm*—Robert T. Kloeppel

[57] ABSTRACT

A golf swing muscle strengthener and swing developer device having a suitable structural member attached to a golf handle. The member may be curved or made up of L shaped members that are clamped to the handle. If L shaped members are used, they are slidabely connected to each other. Weights suspend from the member so that they are directly below the golfer's grip. If a curved member is used, a means for adjusting weights is provided so as to locate the weights properly. The weights are suspended from the member by a single member or a member made up of the two parts: two members that permit one to telescopically slide into the other. There is no restraint of the weights at their upper end so that when they move a noise and vibration are observable; however, as the user becomes acquainted with the feel of a correct swing, an upper restraint may be added. If the noise or vibration are not easily observable, a light or sound generating device or a combination of both may be provided.

28 Claims, 2 Drawing Sheets

GOLF SWING MUSCLE STRENGTHENER AND SWING DEVELOPER DEVICE

BACKGROUND OF INVENTION

1. Field of the Invention

The invention relates to an improvement to a golf club. More particularly the invention relates to a golf club which has been modified to accommodate a weight in a predetermined location to assist in developing the golfer's muscles as well as improving the golfer's swing.

2. Discussion of the Prior Art

In the specification and the claims, I will use terms such as "target line", "swing line", "swing plane", and "club face square to the swing line", so as to eliminate doubt as to their meaning, I will now define these terms. "Target line" means an imaginary line that extends through a golf ball to the target (a point on the golf course which is the immediate objective that the golfer wishes to reach). The "swing plane" is the angle of the swing to the ground. In a good swing, the club head travels around the golfer's body on a plane or imaginary line that runs through the shoulder area to the target line. The "swing line" is the horizontal projection of the swing plane. In other words, if an observer climbed a tall pole directly behind a golfer to a point on the pole above the golfer's head and looked down at the swing plane and the golf club left a trail behind as it traveled the swing plane, the swing line would appear as an arc of a circle with the golfer as the center of the circle. "Lie angle" is the angle the club makes with the ground when the bottom of the club head is flat on the ground and the golfer assumes a correct stance. When I refer to the "club face square to the target line," I mean that the leading edge of the club head is at right angle to the target line at the point the golfer would hit the ball. The "club face square to the swing line" means that the leading edge of the club head is at a right angle to the swing line.

There are several patents that I am aware that inventors in the past have invented to come up with an apparatus to improve a golfer's swing. I will now discuss them below:

Great Britain Patent No. 437,905 describes a golf club that may be used to develop a smooth backswing, body turn and down swing. The club handle has a detachable section that becomes misaligned with the rest of the shaft when a faulty golf swing is used with the golf club. The apparatus that accomplishes this includes a handle that has a looped end that connects at the location on the handle just below where the misalignment occurs. The club can be used as an ordinary club by twisting a tab member so that the tab member lines up with the bearing, which is at the end of the displaceable handle section. The tab prevents the bearing from moving which in turn prevents misalignment. The displaceable section, as mentioned, includes a bearing at its lower end. The amount of resistance the bearing must overcome to result in misalignment is a function of the force exerted by the bearing on the lower portion of the club which in turn is a function of the force an adjustable spring exerts against the bearing.

U.S. Pat. No. 1,930,342 describes a golf club that prevents jerking and lunging, and develops balance and control. The user of this invention can detect an imperfect swing because a vibration and jerkiness is felt while swinging. The invention includes a golf club which has, instead of a head, a swivel connected to one end of the shaft. A chain is connected at one end to the swivel and at its other end to a balanced pear shaped weight. After gripping the handle, the weight is lowered to the ground, and with the proper stance the club is drawn back. If the forwardswing is started prematurely, a quick jerk is felt by the golfer. This is caused by a sudden change in direction from the backswing to the forwardswing in an improper golf swing.

U.S. Pat. No. 3,351,346 describes an invention to perfect an "inside-out" swing to obtain maximum range and accurate directional control of the club. The invention also makes possible development of the muscles used in a golf swing. The invention has a typical golf club handle which ends in a downwardly curving portion. In this curving portion, a removable weight(s) is located. The inventor mentions that the user should progress from a weight one-1¼ pound to six such weights. The inventor further points out that the angle between the hand and curving portion is critical because if its too great the weight will strike the golfer's shoulders; and if too small, the weight will not be behind him. The inventor points out that this angle should be approximately 47½ degrees to remove these concerns.

U.S. Pat. No. 3,772,890 describes an invention which, through sound and vibration, a golfer learns when his swing has reached the end of his backswing. The invention also leaves a divot in the ground as it hits the ball. The direction of the divot allows the golfer to determine if his swing at ball contact is on the correct path.

The invention includes a nylon rope loop that is connected to a weight. The loop is placed over the golf club and allowed to settle to the base of the shaft (adjacent to the head). When the golf club is swung back, its motion stops at the end of the swing. However, the weight continues on under its own momentum until it suddenly stops due to the restriction on its travel caused by the nylon rope. This causes the weight to snap back and hit the club head emitting a sound and vibration along the shaft so as to let the golfer know the top of his backswing has been reached.

U.S. Pat. No. 3,740,053 describes an invention in which a removable weight is added to a golf club prior to an official swing. The inventor contends the added weight "provides an excellent way to limber up ones muscles." The weight comprises a pliable member which is snapped onto the longitudinal center of gravity. (The center of gravity is found by balancing the club on ones finger.) Next a smooth shield is snapped over the pliable member so the open end of the shield is opposite the open end of the member. This combination is held in place by a spring like element that narrows in diameter along its length. The wider end of the element is the end that is first inserted over the pliable member and shield.

U.S. Pat. No. 3,758,117 describes an invention to aid a golfer to acquire a consistent follow-through. The invention includes a weight that is adjusted along a rotatable arm that is in turn connected to the lower end of the golf club shaft through a clamp. The weight is so positioned on the arm so that it swings parallel with the club head so as to exert a force to pull the head and the golfer's hand through the swing after hitting the ball. The location of the weight requires several critical adjustments.

U.S. Pat. No. 3,820,795 describes an invention that permits self-analysis of one's golf stroke by using peripheral vision and the stroboscopic effect of light. The invention comprises a member that has frusto-conical member that slides down the shaft and is located on the lower end of the golf shaft at the hosel. Integral to the member is a tab with a hole of suitable diameter to accommodate a flashlight. When the flashlight is turned on and inserted in the tab, the golfer can track his swing with his peripheral vision which in turn trains the golfer to keep his head down.

U.S. Pat. No. 4,170,356 describes an device that includes a rod that has a soft resilient tip at its free end. The rod is mounted to the upper portion of the golf shaft through a mounting assembly which mounts the device on the golf shaft. The device, after it is located on the golf shaft, is adjusted by a professional golfer so that the free end of the rod will lightly touch the golfer's shoulder when the club has attained its proper position at the end of a well executed backswing.

U.S. Pat. Nos. 4,444,396 and 4,602,788 are similar in that both inventions use a regulation shaft less the head. At the lower end of the shaft were the head is normally found, one or more circular discs of various weights may be located and held in place by a releasable means on top of weights so that the weights may be removed by slipping them up the shaft and over the handle.

U.S. Pat. No. 4,842,280 describes a removable weight that may be secured over the club head. A weight is located in each of the interconnected envelopes that are integral and symmetrical. The envelopes fold over the club head. The envelopes are held in place by straps that circumscribe the heel and toe of the club head but not its sole or bottom.

From the above one can see that there have been many attempts to produce a practice club that will correct or improve a golfer's swing in one or more ways. But none of the aforementioned patents have disclosed an invention that is embodied with the components and that functions as mine does. That is, one that has sufficient weight so located that when the club with my invention connected to it is swung, the plane the weight swings in appears to be fixed. This fixed plane naturally forces the golfer to swing the club in a plane parallel to the weight plane resulting in a more perfect swing. The reason the plane of the weights appears to be fixed is that, if sufficient weight is used, the golfer can only by great exertion move the weights out of the plane the weight travels in when swung by the golfer when the golfer takes a normal stance with a normal waist turn. I refer to the arm motion that corresponds with the weight motion as a natural pendulum motion.

As mentioned, this is done using a golf club without modifying or removing any components of the club such as its handle (G.B. No. 437,905), or its head (U.S. Pat. Nos. 1,930,342, 3,351,346, 4,444,396 and 4,602,788). Further, intended purpose of U.S. Pat. No. 3,772,890 is to determine when a golfer reaches the top of his backswing and also determine the flight path of the head at ball contact by looking at the divot this invention makes in the ground. This invention does not locate weights that results in correct swing that arises out of the pendulum motion of the weight. And U.S Pat. No. 3,758,117 locates a rather complicated weight at a position near the club head. In contrast, my invention locates the weight so a pendulum action results by using conventional weights that may be increased or decreased as the user desires. U.S. Pat. No. 3,740,053 is an invention that is used to limber the golfer's muscles, but it does not improve the golfer's swing as my invention does. On the other hand, U.S. Pat. No. 3,820,795 is an apparatus that allows the user to watch his stroke through the stroboscopic effect of light. But this patent does not teach a means to develop one's golf swing through the use of a weight in the manner I teach. U.S. Pat. No. 4,170,356 describes an invention that is limited to a means that lets the golfer know when he has reached the top of his swing.

My invention, on the other hand, maximizes one's swing by developing a swing that follows golf's five "flight laws of impact geometry" so as to result in a straight long distance ball flight. These laws are: club head path (the line that the club takes towards the ball, at contact of the ball and thereafter); position of the club face to the club head path; the angle of attack to the ball; squareness of contact, that is, hit the ball in the middle of the club head; and club head speed. This is done by (a) clamping the golf club to my invention so that the weight is directly below the golfer's hands when the club head is in line with the invention and the golfer places the golf club in the proper lie angle for that individual and (b) swinging my invention so that a half back and forward pendulum motion is achieved, that is, the shaft of the club is parallel to the ground and the club head is pointing up and perpendicular to the ground at the end of both the back and forward half swing; while at all other points during, the swing the club head is square to the swing line. In order to develop the timing necessary to achieve squareness of the face of the club head to the target line at point of impact or contact to the ball as the face of the club head is moving square to the swing line, the weight of my invention must not be allowed to twist on my invention through the down swing or the forward swing. If it does, a noise is made by the unrestricted weights of my invention as they twist on my invention because of an improper swing which in turn causes a vibration through the shaft. The twist of the weights is seen, and the corresponding vibration and noise are heard and felt by the golfer. This alerts the golfer of the improper swing.

SUMMARY OF THE INVENTION

The invention relates to an apparatus that permits the user to both exercise and develop the right muscles used in the user's golf swing as well develop a geometrically correct swing.

When the invention is used, weights swing back and forth naturally while the user controls the golf club by a mechanically correct swing. More specifically, tubing or other suitable structural shape is attached to the golf handle. The member may be straight, curved or made up of L shaped members that are clamped to the handle. If L shaped members are used, they are slidablely connected to each other. If a curved member is used, a means for adjusting the weights is connected to the curved member so that after adjustment of the weight, the weight lies directly below the hands when the golfer assumes a correct stance with the corresponding lie angle. The weight should hang directly below the hands, which grip the golf club handle. The distance the weights are below the hands is determined by the users's height, posture, length and the lie angle of the golf club. The weights hang down from the curved member by a single member or a member made up of the two parts: two members that permit one to telescopically side into the other. They are held in place by a pin that fits through a hole located in each of the members. Weights are located over the bottom end of the lower of the two members and are held in place at the lower end of the weight by a removable retaining means. Generally, no restraint of the weights is provided at their upper end.

DESCRIPTION OF THE PREFERRED EMBODIMENT

By using the invention, the golfer both exercises and develops the correct muscles used in the golfer's swing. And by repeated use of my invention, a correct swing becomes the natural swing of the golfer. The correct swing results in the golf ball traveling in a straight path for maximum distance.

The golfer who uses my invention swings the golf club and my invention back only to a point that the club is parallel to the ground and the club head is toe up and then forward to a point the club is again parallel to the ground and the club head is toe up. This is repeated until this part of the golf swing becomes natural to the golfer. As mentioned, a correct golf swing results provided (1) the lie angle is set up for the golfer, and (2) there is sufficient weight to prevent wrist movement so the club will not swing off the correct swing plane required for maximum straight ball flight. The exact amount of weight depends on the golfer At times I use 30 pounds. Another golfer may use more or less weight depending on the golfer's strength.

Figure 1:
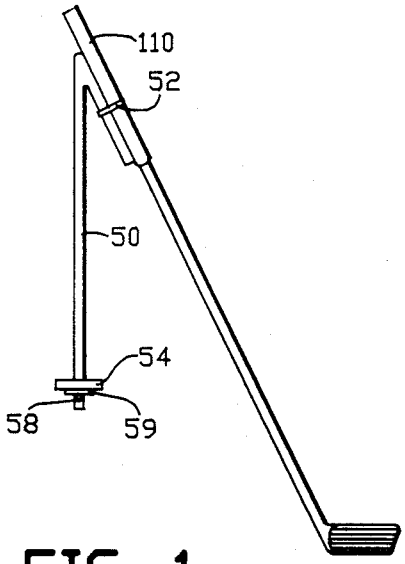
FIG. 1 is an elevation view of my invention connected to a golf club.
Figure 2:
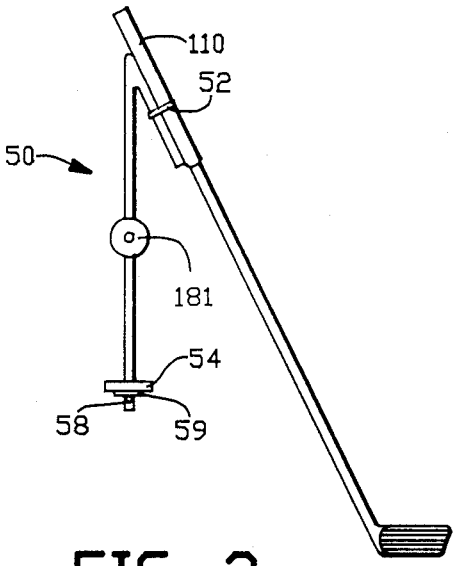
FIG. 2 illustrates the structural member as two portions interconnected by a rotational means.
Figure 5:
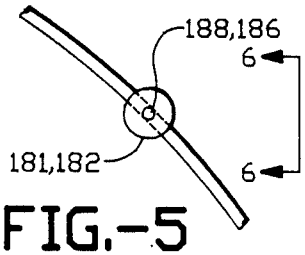
FIG. 5 illustrates another means for adjustablely connecting two members of my invention.
Figure 6:
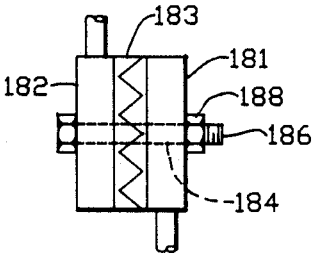
FIG. 6 illustrates a side view of the means illustrated in FIG. 5.

The invention is connected to a golf club having an elongated shaft and a handle portion at the upper end of the shaft and a club head at the lower end of the shaft. As illustrated in FIG. 1, a structural member 50 may be adjustablely connected to the handle portion 110 by a means for connecting it thereto such as clamp 52. The structural member extends down as illustrated in FIG. 1 to a location directly below where a golfer grips the club. A weight 54 is inserted over the lower end of the structural member so that the weight is directly below a golfer's hands while the golfer swings the club head square to a swing line. The weight is held in this position by a retaining means located below the weight. The retaining means is illustrated as pin 58 and washer 59. The structural member may be constructed into two portions as illustrated in FIG. 2. As illustrated in FIGS. 5 and 6, the two portions are rotationally connected by two serrated members 181, 182 that are connected respectively to the ends of the portions of the structural member which they join. These serrated members have serrations 183, FIG. 6, projecting from one side of each member and a hole 184 located centrally in each. A bolt 186 is slid through the hole; and, when the correct orientation of the first member is determined, the serrated members are locked into place by securing the nut 188 to the bolt.

Figure 3:
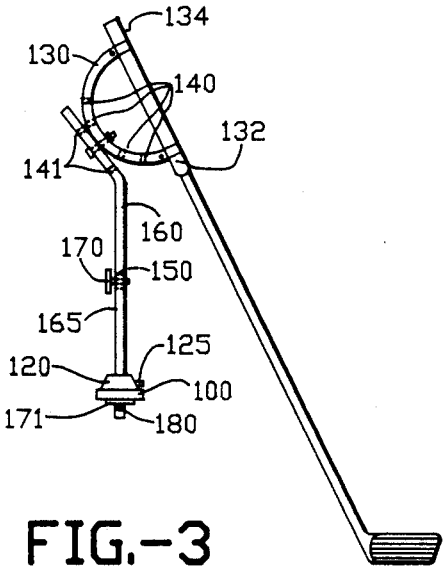
FIG. 3 illustrates the structural member as a member made up of a curved member and a member on which the weight is located.

The structural member may alternatively be a structural member 130, FIG. 3, which is curved and attached to the golf handle at each end of the handle and the curved member by clamps 132, 134. A plurality of holes 140 are drilled in the curved member 130 to connect a first member 160. The first member may have a curved upper portion that has a plurality of such holes 141 fabricated in the curved upper portion A means is provided to adjustablely connect the first member to the curved member for lie angle adjustment so that the weights are directly below the hands when the user takes a correct stance with the club head flat on the ground. This connecting means is discussed below. With the proper weight so that the golfer's wrists do not turn during the forward and backward halfswing, the leading edge of the club face remains square to the golfer's swing line.

Figure 4:
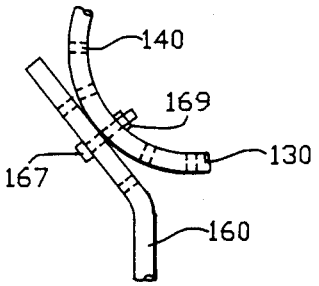
FIG. 4 illustrates in more detail the means for connecting the curved member and the first member of the invention of FIG. 3.

The lie angle adjustment of the weights (that is the adjustment of the weights so that theY are below the hands of the golfer with the golf club's lie angle) can be fixed in the appropriate position by inserting at least one bolt 167 in a hole in both the curved member and the first member and secured in place by nut 169, FIGS. 3 and 4. If additional strength is required at this connection for any reason, then a plurality of bolts may be located through the appropriate holes in each of the members. Thus one example of the means for connecting the curved member to the first member is at least one bolt 167 located through a hole in both the curved member and the first member which is secured by a nut 169 so as to maintained the desired orientation of the two members.

Figure 7:
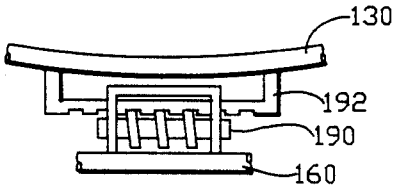
FIG. 7 illustrates yet another means for connecting the curved member to the first member.

Another example of the adjustable means is a pair of one sided serrated members 181, 182, FIG. 5. As described above, these serrated members have serrations 183, FIG. 6, projecting from one side of each member and a hole 184 located centrally in each. A bolt 186 is slid through the hole; and, when the correct orientation of the first member is determined, the serrated members are locked into place by securing the nut 188 to the bolt. Yet another example of the adjustable means includes a gear and gear rack 190, 192, FIG. 7, wherein the gear is rotationally connected to either the curved member or the first member and the gear rack is connected to the other member. In this arrangement, the gear and gear rack engage each other so that when the gear is rotated it moves along the gear rack and in turn moves the weight to its proper location.

Figure 8:
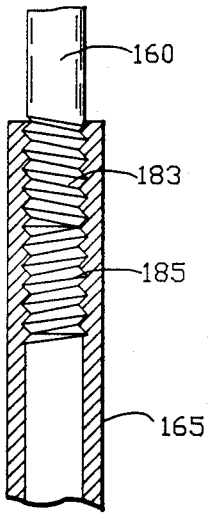
FIG. 8 illustrates an alternate method for connecting the first and second members.

As illustrated in FIG. 3, the first member 160 may telescopically slide over or into or is otherwise adjustablely connected to the second member 165. They are held in place by pin 170 that fits through hole 150. A plurality of such holes may be provided in the first and second members so that the second member can increase or decrease the distance of the weight below the golfer's hands. (The second member may not be needed in those cases were the first member is long enough to get the weight the proper distance below the hands.) Weights are located over the bottom end of the second member 165 (or if the second member is not used, the first member) and held in place by removable retaining means such as pin 180 and washer 171 or threading the lower end of the second member (or first member) and connecting a nut to the threads so that the nut is below the weight. Another means for adjustablely connecting the first and second members is fabricating male 183 and female 185 threads in the members as illustrated in FIG. 8 so that one member may be screwed into or out of the other.

The top of the weight or weights are not secured so that if an incorrect swing occurs, the weights movement causes a vibration to be felt in the shaft and a noise due to the weight movement to be heard by the golfer. The golfer should also see the movement or rotation of the weights. This will not occur with a correct swing. After the golfer gets use to the proper swing, the golfer may find it useful to secure the upper end of the weight by a removable retaining means insertable onto the first member or the second member as the case may be. This can be done by clamping weights 100 in place by a collar 120 which is held in position by a set screw 125, FIG. 3.

One of the major benefits of my invention is that a correct swing occurs naturally. A poor swing must be induced by the golfer through the exertion of extra force. By repeating the swing, a good swing becomes the golfer's natural swing.

Figure 10:
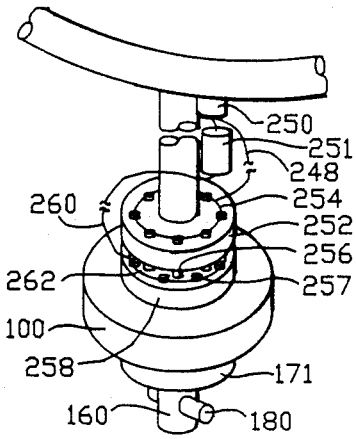
FIG. 10 illustrates one way to generate a noise when the weights of my invention twist indicating an incorrect swing.

I have found that some people may not hear the noise or feel the vibration generated by an improper swing; although the golfer should see the movement if its large enough. In order to draw attention to this, I may include with my invention a means to generate a noise, a light or both which are set off when the weights twist due to an improper swing. There are many ways to do this as understood by those skilled in the art. I illustrate in FIGS. 10–12 several examples of such means. FIG. 10 illustrates a means to generate a noise. The means includes an electrical relay 250 which may be attached to my invention. The relay is electrically connected by wire 248 to a first electrical conductor 254 that is located on a first insulating member 252. The electrical conductor in turn is connected to electrical contacts 256 that passes through the first insulating member. The contacts are equally spaced from each other. Another wire 260 interconnects the relay and a second electrical conductor 262 that is attached to a second insulating member 258 that has electrically conducting contacts 257. The second insulating member is connected to the weight 100 by glue, fasteners or other appropriate ways so that the two move together. Thus if the weight twists, a closed electrical circuit results when the electrical contacts 256 and 257 of members 252 and 258 touch resulting in the flow of electricity which in turn closes the contacts of the relay making a clicking sound. The source of electromotive force is battery 251 which is connected electrically in series with the relay and the contacts as illustrated in FIG. 10.

Figure 11:
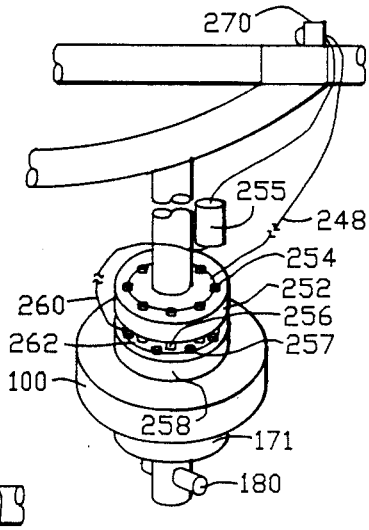
FIG. 11 illustrates one way to generate a light when the weights of my invention twist indicating an incorrect swing.

This can be similarly done with a light 270, FIG. 11 which works in the same manner as the circuit illustrated in FIG. 10, except the electric current causes the light to go on in lieu of closing the relay. The source of electromotive force in the light circuit is battery 255.

Figure 12:
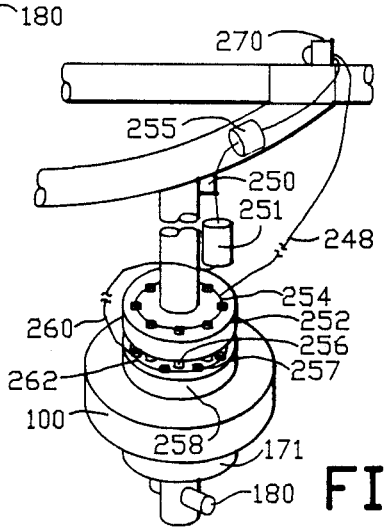
FIG. 12 illustrates a combined noise and light circuit that is activated when an incorrect swing occurs.

The two circuits may combined as in FIG. 12, so that an improper swing will generate both a noise and a light. As before the source of electromotive force for the relay is battery 251.

Once the relay clicks closed, the light circuit also is closed so that the current from battery 255 causes the light to go on.

There are may be other ways to generate the noise and light. For example, the noise may be generated mechanically so as to produce a clicking sound or some other sound as well as by other electrical circuit known by those skilled in the art.

Figure 9:
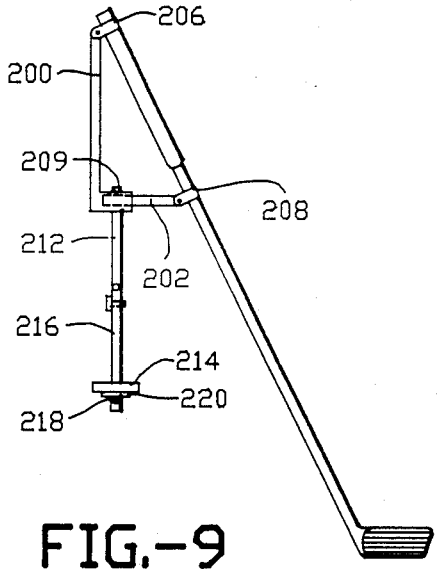
FIG. 9 illustrates an alternate embodiment of my invention.

Another embodiment of my invention is illustrated in FIG. 9. It uses a triangular member in place of the curved member. The triangular member is made up of a first and second components 200 and 202. Component 200 is either an L shaped member or made up of members that are integrally connected into such a shape. One end of component 200 is clamped by clamping means 206 to the upper end of the handle portion of a golf club. The other end of member 200 is adjustablely connected to one end of the second component 202. The other end of the second component is clamped to the lower end of the handle portion by clamping means 208. In FIG. 9, this is accomplished by sliding component 202 into component 200. They are held in place by set screw 209. A first member 212 is connected to one of the components and at least one weight 214 is located over the first member. A means for retaining the weight such as a pin 218 and washer 220 is located below the weight to keep the weight in place. As mentioned before, if the first member 212 is not long enough to obtain the proper distance of the weight below the golfer's hands, a second member 216 may be adjustablely connected to the first member in the same fashion as described above.

My invention is clamped to a golf club so that when the combination is swung by a golfer in practice the club and my invention swing in parallel planes automatically resulting in a correct half swing which can be changed only with the exertion of force to change its path. The momentum of the pendulum carries the golfer's swing in a natural motion through the golf ball—properly turning the waist at the appropriate time so that by just swinging a club to which my invention is connected a good half swing and rhythm is developed so that it becomes a part of the golfer's natural swing. My invention also develops the strength and balance to result in he proper angle of attack and resulting squareness of contact with the ball. Additionally the muscle development will result in additional strength to increase the speed of the club.

The foregoing description and drawings will suggest other embodiments and variations within the scope of the claims to those skilled in the art, all of which are intended to be included in the spirit of the invention as herein set forth.

I claim:

1. A combination comprising a golf club having an elongated shaft having an upper and lower end, a handle portion having two ends, the handle portion located at the upper end of the shaft, a club head at the lower end of the shaft and a golf swing muscle strengthener and swing developer device, said device including at least one weight; a structural member adjustablely connected to the handle portion; means for connecting the structural member to the club; said structural member extending from the handle portion of the golf club to a position directly below where a golfer grips the club; the weight insertable over the lower end of the structural member so that the weight is directly below a golfer's hands while the golfer swings the club head square to a swing line; a first removable means for retaining the weight, said first removable retaining means located below the weight.

2. The combination of claim 1 wherein the structural member is made of at least two portions and further includes a means for rotationally connecting the two portions of the structural members so that the weight may be adjusted about the rotational means.

3. The combination of claim 1 further including a means for generating a noise that corresponds to a twisting movement of the weight.

4. The combination of claim 1 further including means for generating a light that corresponds to a twisting movement of weight.

5. The combination of claim 4 wherein said means for generating a light further includes a means for generating a noise.

6. The combination of claim 1 further including a second removable means for retaining the upper end of the weight, said removable means insertable onto the structural member before the weight.

7. The combination of claim 1 wherein the structural member is a curved member having two ends, and the means for connecting the structural member to the club includes a first and second means for clamping the curved member to each end of the handle portion; said combination further including a first member; a means for adjustablely connecting the first member to the curved member; a second member adjustablely connected to the first member; a means for adjustablely connecting the second member to the first member.

8. The combination of claim 7 wherein the curved member has a plurality of holes and the first member has a curved upper portion having a plurality of holes and the means for adjustablely connecting the first member to the curved member includes at least one bolt and nut, wherein the bolt passes through a hole in both the curved member and the first member and the nut is secured to the bolt.

9. The combination of claim 7 wherein the means for adjustablely connecting the first member to the curved member is a pair of serrated members having serrations projecting from one side of each serrated member and a hole located centrally in each serrated member wherein one serrated member is secured to the curved member and the other serrated member is secured to the first member so that the serrations projecting from each serrated member engage; a nut and a bolt wherein the bolt passes through the hole in each of the serrated members so that when the proper location of the weight is found, the bolt is located into the hole of each serrated member and secured by tightening the nut against the bolt that passes through the hole of each of the serrated members.

10. The combination of claim 7 wherein the means for adjustablely connecting the first member to the curved member is a rotatable gear and a gear rack that engage each other and are connected to the curved and first member so that when the rotatable gear is rotated the gear moves along the gear rack so in turn the weight can be located below the golfer's hands.

11. The combination of claim 7 further including a means for generating a noise that corresponds to a twisting movement of the weight.

12. The combination of claim 7 further including means for generating a light that corresponds to a twisting movement of weight.

13. The combination of claim 12 wherein said means for generating a light further includes a means for generating a noise.

14. The combination of claim 7 further including a second removable means for retaining the upper end of the weight, said removable means insertable onto the structural member before the weight.

15. A combination comprising a golf club having an elongated shaft having an upper and lower end, a handle portion having two ends, the handle portion located at the upper end of the shaft, a club head at the lower end of the shaft and a golf swing muscle strengthener and swing developer device, said device including a curved member having two ends, a first and second means for clamping the curved member to each end of the handle portion; a first member; a means for adjustablely connecting the first member to the curved member; at least one weight insertable over the lower end of the first member; a first removable means for retaining the weight, said retaining means located below the weight; and wherein the means for adjustablely connecting the first member to the curved member is adjusted so that the weight is directly below a golfer's hands while the golfer takes a stance to commence a swing in a plane so the club head is square to the swing line throughout the swing.

16. The combination of claim 15 further including a second removable means for retaining the upper end of the weight, said second removable means insertable onto the first member before the weight.

17. The combination of claim 15 wherein the curved member has a plurality of holes and the first member has a curved upper portion having a plurality of holes and the means for adjustablely connecting the first member to the curved member includes at least one bolt and nut, wherein the bolt passes through a hole in both the curved member and the first member and the nut is secured to the bolt.

18. The combination of claim 15 wherein the means for adjustablely connecting the first member to the curved member is a pair of serrated members having serrations projecting from one side of each serrated member and a hole located centrally in each serrated member wherein one serrated member is secured to the curved member and the other serrated member is secured to the first member so that the serrations projecting from each serrated member engage; a nut and a bolt wherein the bolt passes through the hole in each of the serrated members so that when the proper location of the weight is found, the bolt is located into the hole of each serrated member and secured by tightening the nut against the bolt that passes through the hole of each of the serrated members.

19. The combination of claim 15 wherein the means for adjustablely connecting the first member to the curved member is a rotatable gear and a gear rack that engage each other and are connected to the curved and first member so that when the rotatable gear is rotated the gear moves along the gear rack so in turn the weight can be located below the golfer's hands.

20. The combination of claim 15 further including a means for generating a noise that corresponds to a twisting movement of the weight.

21. The combination of claim 15 further including means for generating a light that corresponds to a twisting movement of weight.

22. The combination of claim 21 wherein said means for generating a light further includes a means for generating a noise.

23. A combination comprising a golf club having an elongated shaft having a lower and upper end, a handle portion having two ends located at the upper end of the shaft, a club head at the lower end of the shaft and a golf swing muscle strengthener and swing developer device, said device including a first component having an L shaped configuration having two free ends, a second component having two free ends, a pair of clamping means for adjustablely securing each component at one of each component's free ends to each end of the handle portion so that the other free end of each component points to the free end of the other component, a means for adjustablely securing the other free end of the first component to the other free end of the second component in a predetermined location, a first member connected to one of the components so that when the components are adjusted the first member will be adjusted accordingly, at least one weight insertable over the first member, a first removable means for retaining the weight, said retaining means located below the weight.

24. The combination of claim 23 further including a second removable means for retaining the upper end of the weight, said second removable retaining means insertable onto the first member before the weight.

25. The combination of claim 23 wherein a second member is adjustablely connected the first member; a means for adjustablely connecting the second member to the first member so that the second member performs as an extension of the first member.

26. The combination of claim 23 further including a means for generating a noise that corresponds to a twisting movement of the weight.

27. The combination of claim 23 further including means for generating a light that corresponds to a twisting movement of the weight.

28. The combination of claim 23 wherein said means for generating a light further includes a means for generating a noise.

* * * * *